United States Patent [19]

Schmitz

[11] 4,266,758

[45] May 12, 1981

[54] SUPPORT FOR A METALLURGICAL VESSEL

[75] Inventor: Günter Schmitz, Duisburg, Fed. Rep. of Germany

[73] Assignee: Mannesmann Demag AG, Duisburg, Fed. Rep. of Germany

[21] Appl. No.: 118,491

[22] Filed: Feb. 4, 1980

[30] Foreign Application Priority Data

Feb. 12, 1979 [DE] Fed. Rep. of Germany ..... 2905283

[51] Int. Cl.[3] ..... C21C 5/42; C21C 5/50

[52] U.S. Cl. ..... 266/244; 266/246

[58] Field of Search ..... 266/244–246

[56] References Cited

U.S. PATENT DOCUMENTS 3,711,077 1/1973 Nagato ..... 266/246

3,756,583 9/1973 Nagati ..... 266/246

4,121,811 10/1978 Fisher ..... 266/246

FOREIGN PATENT DOCUMENTS 1533909 4/1975 Fed. Rep. of Germany ..... 266/244

*Primary Examiner*—P. D. Rosenberg

*Attorney, Agent, or Firm*—Mandeville and Schweitzer

[57] ABSTRACT

A support is provided for a metallurgical vessel, in which paired tie rods are provided superimposed upon each other to absorb the stress resulting from thermal expansion and contraction in the support. By superimposing pairs of the tie rods upon each other and prestressing them, a substantial capacity is provided for absorbing built-up stresses in the support while requiring relatively less space for accommodating the tie rods. The paired compression heads and tie rods are positioned concentric to each other on the same axis.

5 Claims, 4 Drawing Figures

SUPPORT FOR A METALLURGICAL VESSEL

BACKGROUND AND STATEMENT OF THE INVENTION

The invention relates to the support for a metallurgical vessel, particularly a tiltable and/or revolving steel mill converter which is held in one or several annular supports or raceways, or if necessary, several such supports which surround the vessel but are spaced a distance from it, by means of individual or joined support claws attached to the vessel wall, and pliable, extendible and/or compressible tie rods positioned parallel and/or at right angles to the longitudinal axis of the vessel. The tie rods are under initial stress, so that initial stress units are formed consisting each of a claw with clamp heads, extendible tie rods, and an annular support and/or raceway with clamp heads.

Bearings of a metallurgical vessel require additional means to accommodate thermal balance relative to the apparatus supporting and surrounding the vessel. The usual and proven practical vessel bearings afford a special status to those using in the system initial stress tie rods. The vessels suspended from pliable, expandible tie rods in the annular support may be tilted into any desired tilting position without jolts, and nontiltable vessels may be placed without difficulties relative to the great thermal expansion forces involved with optimum utilization of the tie rods stressed by tensile forces.

For each of the most important stress or load directions occurring in operation, tie rods are provided and arranged in the stress direction. At right angle with these stress directions the tie rods, therefore, do not receive any essential forces. They bend in these directions, and thus make the bearing flexible or yielding when thermal stress occurs. Another advantage of the initial stress system results from the elasticity of the tie rods in the area of the so-called Hooke stress where, as is well known, the extension of the tie rod increases linearly with the load.

The system of the initial stress, pliable, expandible tie rods operates in such a manner that the tie rods are stressed during assembly of the vessel up to an initial stress force. Thus, the tie rods lengthen by the intended amount, while the parts joined by the tie rods (claw and annular support and/or claw and raceway) are simultaneously compressed by a certain amount. If an operating force is then added consisting of the converter weight together with the weight of its brick lining and its contents, the tie rods are stressed even more, and the claws and/or annular supports or raceways are relieved. When altering the operating force from zero to a maximum force, the force in the tie rods only changes by the differential force which is the maximum force minus the initial stress force, if the connection of the claw with the annular support and/or claw with the raceway is under initial stress with the operating force. If, however, the initial stress force is lacking, this differential force increases considerably, and matches the maximum force.

The longer such tie rods are selected, the easier a slightly S-shaped bending of the tie rods occurs, thus providing a corresponding pliability vs. thermal stress. For a greater constructive length of the tie rods, therefore, spacing pipes are inserted between the claw and the annular support and/or between the claw and the raceway, their length thus representing a means for influencing the bending characteristics of the tie rods.

German DE-PS No. 15 33 909 discloses how such bearings for vessels are provided as a connection between a metallurgical vessel and an annular support or raceway according to the initially mentioned combination by means of a desired number of initial stress units. Depending on the great stress on a tie rod resulting from the weight of the vessel together with its brick lining and the weight of its contents, it is necessary to provide more than one tie rod in a mounting area between the vessel and the annular support and/or between the vessel and the raceway. It is known to arrange two such tie rods in a mounting area side by side or superimposed. The size of the individual tie rod cross sections is, however, limited by the initial stress to be applied and by the surface compression occurring between claw and annular support and/or raceway.

Larger vessels, on the other hand, require tie rods of accordingly larger dimensions, which may be burdened with greater loads, accordingly. However, the stress or load capacity of individual tie rods is limited by their coordinated initial stress force. Practice has shown that such initial stress forces can only be managed somewhat easily up to the range of about 300 Mp utilizing the available mobile hydraulic jigs or clamping devices, so that the capacity of tie rods made of high-duty materials cannot be exploited fully. On the other hand, the arrangement of any desired number of tie rods, each forming an initial stress unit, on annular supports or raceways is impossible, as the latter must be kept narrow, if only in view of their economical manufacture. Such annular supports or raceways may also be kept narrow which is a result of their bending stress. These dimensioning endeavors would be opposed by inappropriate demands on the part of the required base areas for the connection of the tie rods, because corresponding cross sectional areas would have to be created in order to accommodate the desired number of tie rods.

It is the object of the present invention to better utilize the stress capacity of the initially mentioned initial stress units, in order to make do with the area for attachment available on the annular support and/or raceway ends for a relatively small number of initial stress units.

The invention here solves this problem for the initially described vessel attachments provided with the above mentioned initial stress units by superimposing at least one additional initial stress unit whose clamp heads are each supported indirectly or directly on the first initial stress stage, so that each initial stress unit penetrates the other and/or others with its expandible tie rods. This solution has several advantages. A double or multiple initial stress unit results, onto which the necessary initial stress forces and/or loads of at least two initial stress units are transferred as usual. The distribution of the load is onto two separate initial stress units, to be true, but in such a way that one initial stress unit receives the other within itself. This results in a substantial space-saving arrangement leading to considerable additional advantages in the remaining design of the vessel construction.

Another advantage is that the application of the initial stress force and its release may take place in one or more stages in such a way that at first one initial stress unit is treated with the maximum force of the available hydraulic jig, and then each further initial stress unit. This makes it possible to fully utilize, double and/or multiply the available maximum forces of the currently marketed hydraulic jig, or to keep the hydraulic jigs used relatively small. In view of the construction, the initial stress unit, according to the invention, has especially favorable results, with narrow annular supports in their pivot pin area that often during reconstruction and related vessel enlargements cause difficulties. The high space-saving feature of the structure permits arrangement of the tie rods transmitting great initial stress forces on especially narrow annular supports.

According to a further improvement elaborating on the concept of the invention, several of the superimposed initial stress units are arranged symmetrically with a common central axis. This serves to simplify the systematic computation of equally large initial stress forces in the individual expandible tie rods. This space-saving arrangement is further improved on by arranging several clamp heads of different initial stress units concentrically with the common center axis.

The application of the initial stress forces by means of the above-mentioned hydraulic jigs is simplified if the tie rods of one initial stress unit are arranged on an interior ground plan surface, and the tie rods of the other initial stress units on exterior annular ground plan surfaces. The application of the initial stress forces in stages is, furthermore, facilitated by the fact that the clamp heads of several initial stress units are supported on each other. The clamp heads may be mounted to support themselves independently by their clamping nuts on the claws and annular supports and/or raceways to be rigged, which contributes to an easy independent initial stress transmittal.

Examples of the invention are shown in the drawings, and explained as follows:

DETAILED DESCRIPTION OF THE INVENTION

Figure 1:
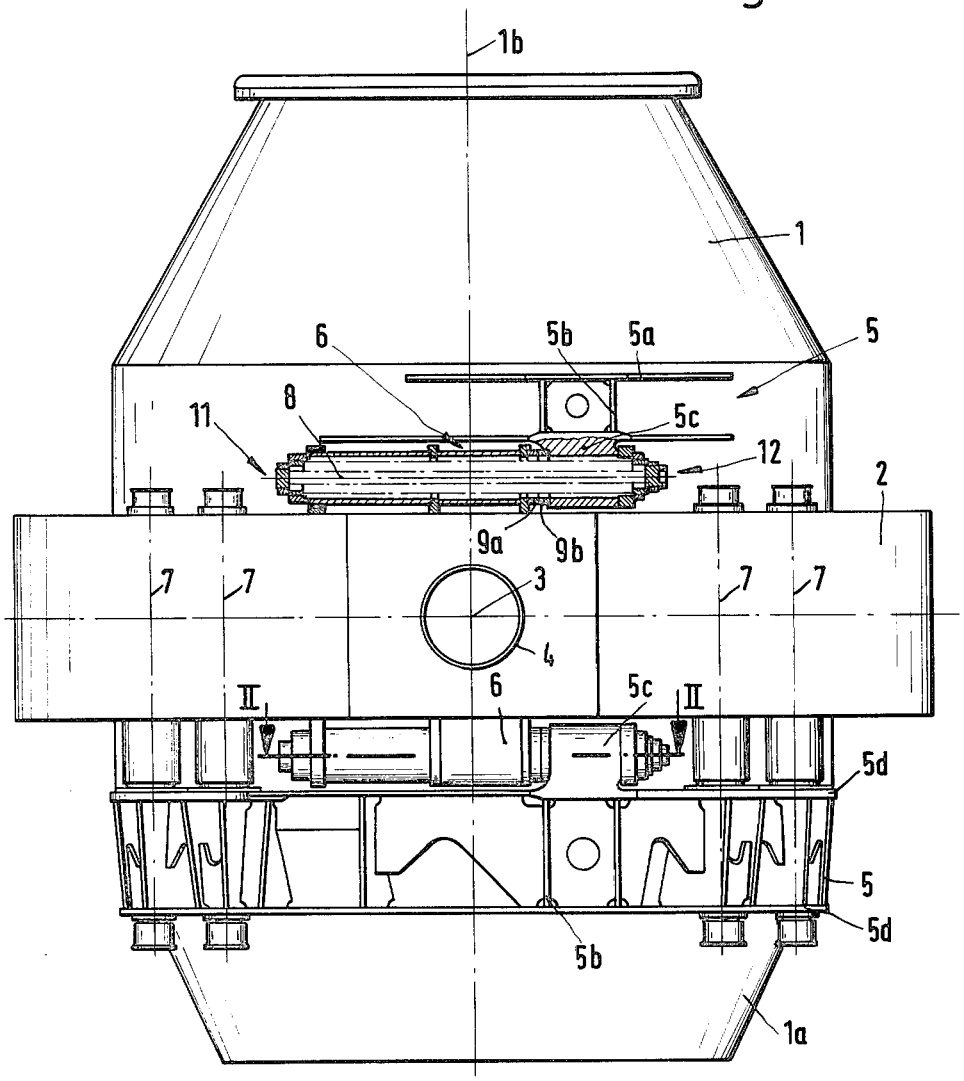
FIG. 1 is a vertical side elevational view of a steel mill converter resting on the surrounding annular support by means of two initial stress units positioned vertically of one another.

The metallurgical vessel 1 consists of a converter vessel which is operated in the refining process. Within this metallurgical process, temperatures of over 2000° C. occur in the center of the refining gas supply. These high temperatures produce correspondingly high temperatures in the brick lining, and in the vessel shell surrounding it. From the vessel shell, the heat radiates to the apparatus parts surrounding the metallurgical vessel.

The vessel 1 is supported to be tiltable for charging, refining and tapping. The annular support 2, itself being supported by means of pivot pins 4 provided in the pivot axis 3 in pivot bearings not shown, serves as the tilting apparatus. The annular support 2 is, in a situation where revolving vessels are used, replaced by raceways supported on known roller arrangements, not shown, whereby the rollers are pivoted in tilting mechanisms comparable to the annular support 2.

The connection between the vessel 1 and the annular support 2 consists first of individual support claws 5 formed by ribs **5*a* and stays 5*b* welded to the vessel shell, and provided with a bearing-like extension 5*c*. The support claws 5 may also be formed of joined or coupled claw rings 5*d* and stays 5*b*. Due to the lower operating temperatures, the claw rings 5*d* may be arranged in the lower area 1*a* of the vessel without constrictive or binding stress. In this variation, the extensions 5*c* are also present. Attached to the annular support 2 are abutments 6** formed of welded casing structures.

The initial stress units, according to the invention, are arranged with the direction of their center axes 7 extending parallel with the main vessel axis **1*b*, and with the direction of their center axes 8 extending perpendicular to the main vessel axis 1*b*. The initial stress units on the center axes 7 carry the vessel 1** when it is in upright and top positions, and carry the weight components in the tilting positions between 0° and 180° and/or between 180° and 360°.

In the horizontal position of the main vessel axis **1*b* (the so-called 90° position of the vessel), the initial stress units carry on the center axis 8, which are shown in the example arranged in pairs on each side of the vessel. The vessel, according to FIG. 1, is connected to the annular support 2 by means of a total of 12 initial stress units. Eight of these initial stress units carry in the direction of the center axes 7 and four of these initial stress units carry in the direction of the center axes 8**.

The connection between the vessel 1 and the annular support then consists of the initial stress units. One initial stress unit (FIG. 2) consists individually of a bearing extension **5*c* fixed on the vessel 1, and the abutment 6 on the annular support 2, annular spacers 9*a*, 9*b* arranged between the two, a tubular spacing pipe 10, clamp heads 11 and 12, as well as the system of several tie rods 13, 14 to be explained in detail. The length of the spacing pipe 10 structurally determines the length of the tie rods 13, 14. The length of the tie rods 13, 14 influences, as mentioned, their yielding or bending at right angles to the center axes 7 and/or 8, so that thermal stresses between the vessel 1 and the annular support 2 are intercepted without the risk that the vessel might be displaced with a jolt in the annular support 2 during the tilting process. The tie rods may, in an extreme case, adopt a slight S-shape. To this end, the tie rods 13 and 14** are either rods of full cross section, rods with tubular cross section, or bundles of individual wires.

When mounting the vessel 1 in the annular support 2, the package consisting of the bearing extension **5*c*, spacers 9*a*, 9*b*, abutment 6, and spacer pipe 10, is compressed with the desired initial stress force, and this condition is fixed by means of clamp nuts, still to be described, at the clamp heads 11 and 12** by fastening. Such procedure is followed for each of the initial stress units.

Figure 3:
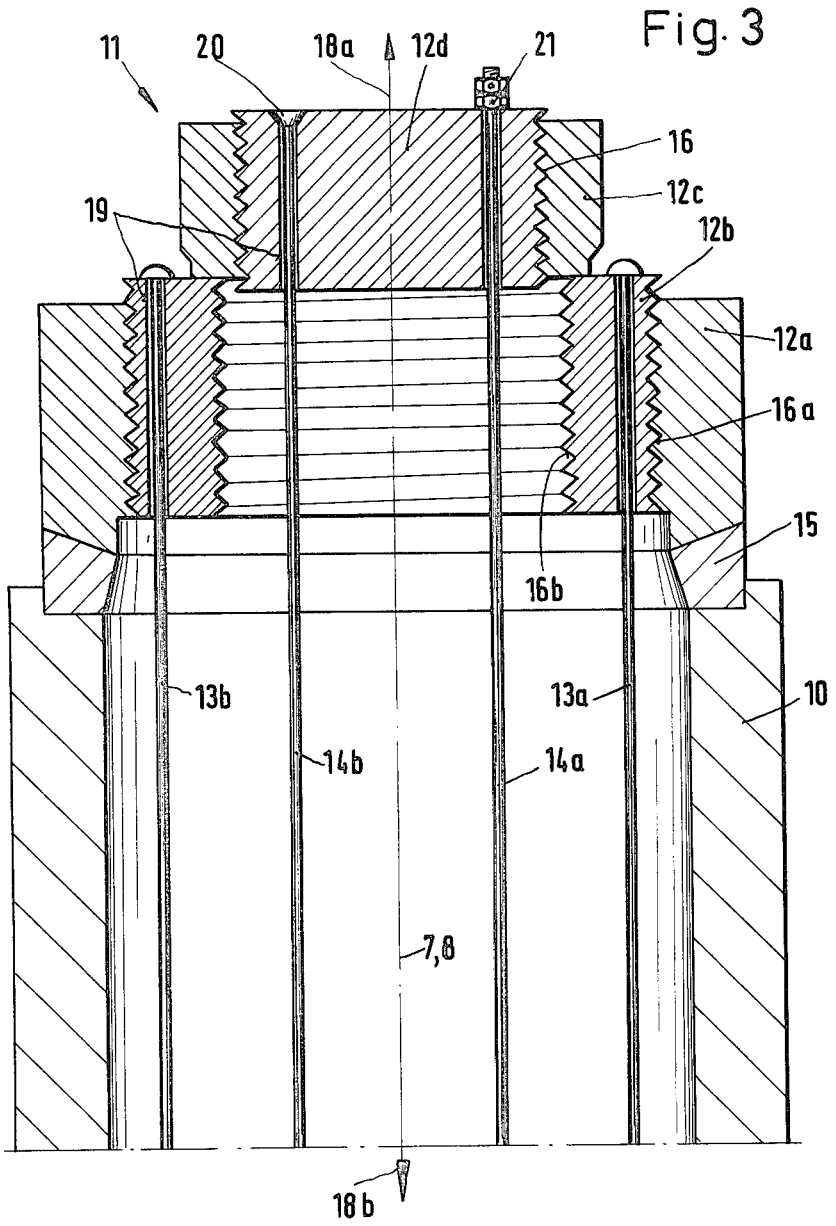
FIG. 3 is an enlarged axial sectional view of one end of the stress connection of an initial stress unit illustrating the invention.

In principle, it is possible to execute a two- or multi-stage initial stress process either on the side of the clamp head 11 only, or on the side of the clamp head 12 only. In the present example, the application of the first initial stress stage is done in the direction of the arrow **18*a*, and the application of the second initial stress stage is done in the direction of the arrow 18*b* (FIG. 3). For the second initial stress process, the core clamp head 12*d* on the side of the clamp head 12 is provided with an extension so that the clamp nut of a hydraulic jig, not shown here, may be screwed onto the thread 16 of the core clamp head 12***d*, in addition to the clamp nut 12*c* already screwed on.

Figure 2:
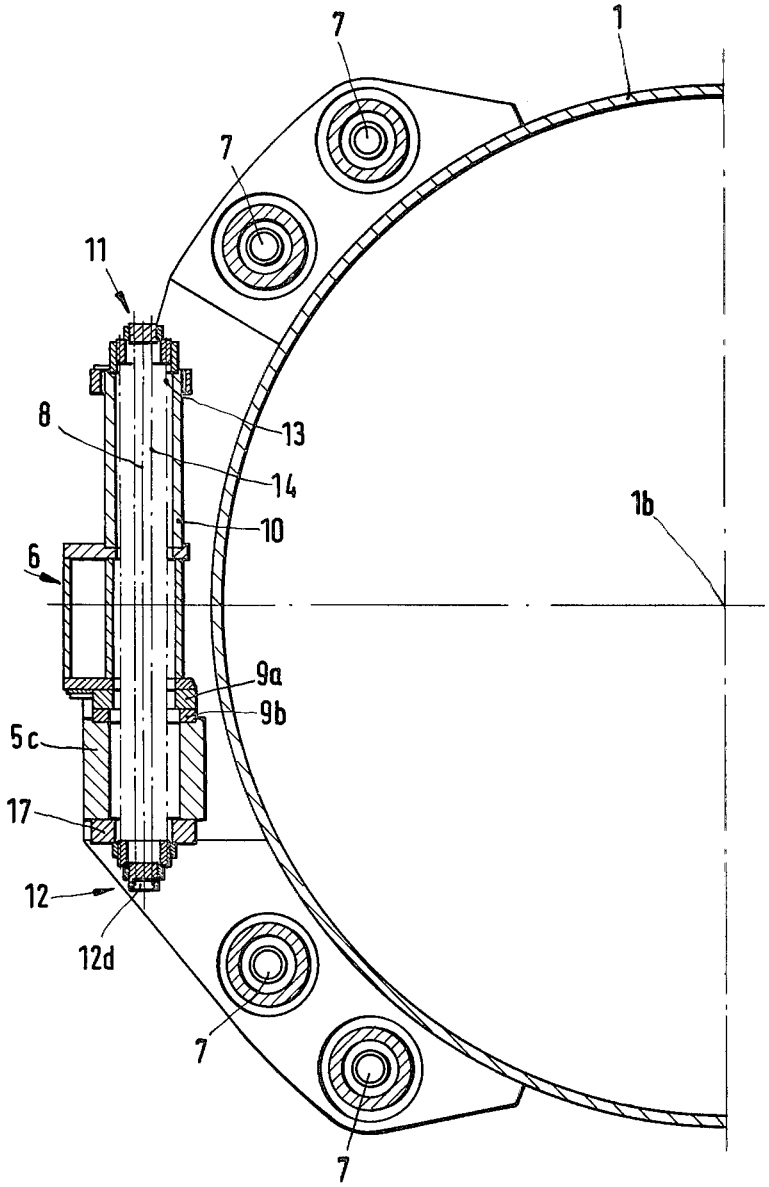
FIG. 2 is an enlarged cross sectional view along lines II—II of FIG. 1.
Figure 4:
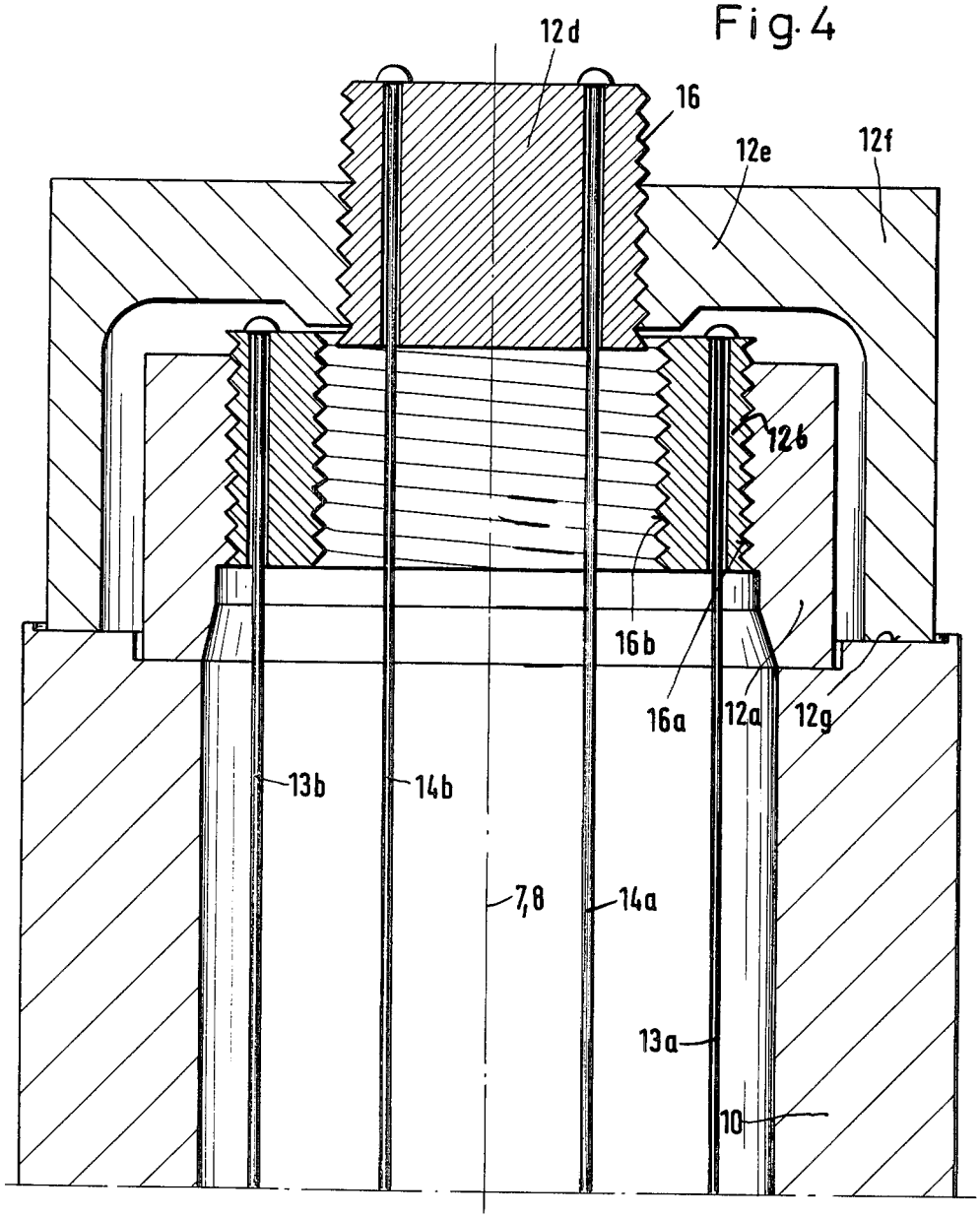
FIG. 4 is an enlarged axial sectional view of a modified example of the initial stress unit of FIG. 3.

In FIGS. 3 and 4, the metallurgical vessel 1, provided with the invention in FIGS. 1 and 2, is shown with its initial stress units. A first initial stress unit, of which the spacing pipe 10 is drawn, is superposed by another, second initial stress unit building on the first initial stress unit. A bearing ring 15 spherical on one side, extends into spacing pipe 10, centrally. Resting on the bearing ring 15 is the first clamp head nut 12*a*, with a matching cooperating spherical bottom, in which the clamp head ring 12*b* is to be screwed by means of thread 16*a*. The tie rods 13*a* and 13*b* are anchored in the clamp head ring 12*b*.

In this phase, the clamp nut 12*c* and the core clamp head 12*d* are not yet installed. The clamp head ring 12*b* is therefore used, with its interior thread 16*b*, to screw in a clamp screw with matching thread 16*b* of the hydraulic jig. After applying the initial stress force, which may amount to 300 Mp, for example, onto the clamp head ring 12*b* in the direction of the arrow 18*a*, the first initial stress stage is created by tightening the tie rods 13*a*, 13*b*. In this condition, the clamp head nut 12*a* is fastened until it adheres to the bearing ring 15. Towards the end of the screw process, an approximation of the clamp head ring 12*b* and clamp head nut 12*a* to the position of the bearing ring 15 takes place.

In this phase, it is now possible to bring a pair of core clamp heads 12*d* together with the tie rods 14*a*, 14*b* into the position shown in FIG. 3. Thereafter, the clamp nuts 12*c* are screwed on. Then, a clamp nut, not shown, of the hydraulic jig is screwed on to the thread 16 of the core clamp nut 12*d* (FIG. 2).

After applying the second initial stress force, which may again amount to 300 Mp, for example, the clamp nut 12*c* is tightened on the side of the clamp head 12. The clamp nut 12*c* thus rests on the clamp head ring 12*b* located below the first initial stress stage. Now, by compressing the clamp nut 12*c*, the clamp head ring 12*b* of the clamp head nut 12*a*, the bearing ring 15, the spacing pipe 10, the abutment 6 at the annular support 2 (FIG. 2), the spacers 9*a*, 9*b*, the extension 5*c* on the vessel 1, and the bearing ring 17 the second initial stress unit superimposed on the first initial stress unit is formed. Then, the core clamp head 12*d* in which the tie rods 14*a*, 14*b* are anchored, is fastened in the clamp nut 12*c*. When creating the second initial stress stage, the hydraulic jig, therefore, operates in the direction of the arrow 18*b*.

The tie rods 13 and 14, are each arranged in a circular ring formation as viewed in plan with one in an interior circle and one surrounding it. Their number is merely limited by a distance of the boreholes 19 which are greater than the diameter of the tie rods 13 and 14, to be kept in the core clamp head 12*d* and/or in the clamp head ring 12*b*. The tie rods 13 and 14 may also consist of bundles of thin individual wires, thus increasing the pliability, so that the thermal expansion forces between the vessel 1 and annular support 2 are met by little resistance. The attachment of the ends of the tie rods 13 and 14 may be formed by means of compression heads 20, thread counter nuts 21, as shown in FIG. 3, or other similar devices.

In the variation according to FIG. 4, the first initial stress unit matches that in accordance with FIG. 3, in principle. Different is only the second initial stress unit relative to the clamp nut 12*e*. The clamp nut 12*e* has the shape of an annular casing 12*f*. It does not rest, therefore, on the clamp head ring 12*b*, but on the spacing pipe 10 at 12*g*. Thus, the clamp head ring 12*b* and the clamp head nut 12*a* on the one hand, and the clamp nut 12*e* as well as the core clamp head 12*d* on the other hand, form separate initial stress bracings. This separation permits the application or release of the initial stress stages successively. At the same time, smaller, possibly portable, hydraulic jigs may be utilized to apply initial stress on the two separate initial stress units.

The application of the second initial stress stage over the first initial stress unit already accomplished, results in a negligible reduction in the initial stress force of the first initial stress unit. In an example which provides 320 Mp for the first initial stress unit and 300 Mp for the second initial stress unit whereby a total initial stress force of 620 Mp would be expected, only 600 Mp total are actually reached. These initial stress forces which may be produced in the center axes 7 and/or 8 are faced by lower operating forces, so that the vessel is always without play, but with elasticity in the annular support and/or in the raceways.

I claim:

1. A support for a metallurgical vessel, comprising (a) annular support means spaced from the surface of said vessel;

(b) claw means disposed on said vessel and connected to said annular support means;

(c) a plurality of pliable expansible and compressible first tie rod structures positioned in said annular support means;

(d) said first tie rod structures being positioned parallel to and perpendicular to the longitudinal axis of said vessel;

(e) each said first tie rod structure being placed under an initial stress; the improvement characterized by (f) each said first tie rod structure extending between a claw means and an annular support means;

(g) a second tie rod structure superimposed on each one of said first tie rod structures;

(h) a clamp head for each said first tie rod structure;

(i) a clamp head for each said second tie rod structure;

(j) said clamp head for said second tie rod structure is supported on its respective first tie rod structure; and (k) a plurality of tie rods extending adjacent to each other in each respective first and second tie rod structure.

2. The apparatus of claim 1, further characterized by (a) each said adjacent first and second tie rod structure are concentric.

3. The apparatus of claim 2, further characterized by (a) the tie rods of said first tie rod structure surround the tie rods of said second tie rod structure.

4. The apparatus of claim 1, further characterized by (a) the said clamp heads of each said second tie rod structure are supported on the said clamp heads of said first tie rod structure.

5. The apparatus of claim 1, further characterized by (a) the said clamp head of each said first tie rod structure is supported on its associated claw means; and (b) the said clamp head of each said adjacent second tie rod structure is supported on its associated annular support means.

* * * * *